US007233767B2

(12) United States Patent
Endo et al.

(10) Patent No.: US 7,233,767 B2
(45) **Date of Patent: *Jun. 19, 2007**

(54) HEATING APPARATUS, SHEET FEEDING APPARATUS AND IMAGE FORMING APPARATUS

(75) Inventors: Saijiro Endo, Chiba (JP); Takeshi Suga, Ibaraki (JP); Jun Agata, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/121,138

(22) Filed: May 4, 2005

(65) Prior Publication Data

US 2005/0201791 A1 Sep. 15, 2005

Related U.S. Application Data

(62) Division of application No. 10/687,807, filed on Oct. 20, 2003, now Pat. No. 6,952,556.

(30) Foreign Application Priority Data

Oct. 25, 2002 (JP) ..... 2002-311106

(51) Int. Cl.
*G03G 15/00* (2006.01)
*G03G 21/20* (2006.01)

(52) U.S. Cl. ..... 399/390; 399/97; 399/391

(58) Field of Classification Search ..... 271/42; 347/102, 104; 399/94, 97, 390, 391, 393
See application file for complete search history.

(56) References Cited

U.S. PATENT DOCUMENTS 4,306,802 A * 12/1981 Kucera et al. ..... 399/390
5,455,659 A 10/1995 Ishizu et al. ..... 355/209
5,600,427 A 2/1997 Watanabe et al. ..... 399/97
5,612,776 A 3/1997 Machino et al. ..... 399/43
5,678,127 A 10/1997 Suga ..... 399/45
5,841,362 A 11/1998 Nakamura et al. ..... 340/825.03
6,032,941 A 3/2000 Endo ..... 271/3.19
6,059,285 A 5/2000 Suga et al. ..... 271/228
6,260,840 B1 7/2001 Suga et al. ..... 271/10.12
6,375,318 B1 * 4/2002 Johnson ..... 347/102
6,421,139 B1 7/2002 Takami et al. ..... 358/1.2

FOREIGN PATENT DOCUMENTS

JP 7-53075 2/1995
JP 2001-348131 12/2001

OTHER PUBLICATIONS

Office Action/Search Report issued by the Chinese Patent Office in Chinese Patent Application No. 2003-101043580.

* cited by examiner

*Primary Examiner*—Hoang Ngo
(74) *Attorney, Agent, or Firm*—Fitzpatrick, Cella, Harper & Scinto

(57) ABSTRACT

A sheet feeding apparatus is provided with a sheet stacking device for stacking sheets thereon, a sheet feeding device for feeding the sheets stacked on the sheet stacking device, and a heating device for heating the sheets stacked on the sheet stacking device. The heating device is designed such that of the heat generating areas of the heating device, the heating value of the heat generating area for the central portion of the sheets stacked on the sheet stacking device is greater than the heating values of the other heat generating areas.

10 Claims, 9 Drawing Sheets

HEATING APPARATUS, SHEET FEEDING APPARATUS AND IMAGE FORMING APPARATUS

This is a divisional application of U.S. patent application Ser. No. 10/687,807, filed Oct. 20, 2003, now U.S. Pat. No. 6,952,556.

BACKGROUND OF THE INVENTION

1. Field of the Invention

The invention relates to a heating apparatus, and a sheet feeding apparatus and an image forming apparatus having heating means for heating sheets.

2. Related Background Art

In an image forming apparatus such as a copying machine or a laser beam printer, design has heretofore been made such that a toner image is formed on a photosensitive drum, and this toner image is transferred to a sheet fed out of a sheet feeding cassette which is sheet stacking means, whereafter the sheet is heated and pressurized in a fixing portion to thereby fix the toner image on the sheet.

In such an image forming apparatus, however, when the sheet absorbs much moisture, that is, when the sheet contains a great deal of moisture therein, the volume resistivity of the sheet falls and therefore, the sheet may sometimes be short-circuited in other grounded portion than a transferring position while the toner image is being transferred. When the sheet is thus short-circuited in other grounded portion than the transferring position, a transferring current does not work well to thereby cause faulty transfer, and this has resulted in the problem that a faulty image occurs. Also, when the sheet absorbs much moisture, there is the problem that wrinkles are liable to occur to the sheet when the sheet passes a fixing roller provided in the fixing portion.

Further, generally, when the sheet absorbs mush moisture, if the sheet is heated and pressurized in the fixing portion, the amount of curl of the sheet becomes great and therefore, after fixing, there occurs the inconvenience that the sheet twines around the fixing roller to thereby cause the clogging of the sheet. Also, when image forming is to be effected on the two sides of the sheet, there occurs the inconvenience that due to curl occurring during image forming on a first side, the sheet twines around a photosensitive drum in the case of image forming on a second side.

So, in order to solve the problems as noted above, it has heretofore been proposed, for example, to install a heating apparatus below the sheet, and heat the sheet by this heating apparatus to thereby remove the moisture of the sheet.

FIG. 8 of the accompanying drawings shows the construction of such a conventional heating apparatus, and this heating apparatus is provided with a heater 80 and a radiation plate 81 on which the heater 80 is mounted. The radiation plate 81 is disposed between the bottom plate 101 of an image forming apparatus and a sheet S with the heater-mounted surface thereof facing down, to thereby heat the sheet S from below. Electric power supply is effected to the heater 80 from a power source contained in the image forming apparatus, or an external power source.

Now, in the conventional image forming apparatus provided with such a heating apparatus, it is often the case that by the recent user's demands for the downsizing and energy saving of the image forming apparatus, the heating apparatus is compelled to be installed below and in proximity to a sheet feeding cassette stacking sheets S thereon, from the viewpoints of space and efficiency.

However, when as described above, the heating apparatus is installed below and in proximity to the sheet feeding cassette, a temperature distribution based on the disposition of a heater intactly affects the surface of the sheets immediately above the radiation plate and as a result, in some cases, the sheets S are locally heated and the humidity distribution and temperature distribution of the sheets S are remarkably partial.

When the humidity distribution and temperature distribution of the sheets S are thus remarkably partial, the sheets S become warily deformed as shown in FIG. 9 of the accompanying drawings, and if in such state, the sheets S are conveyed to a transferring portion, there will arise the inconvenience that faulty transfer is partly caused.

To solve such an inconvenience, it is necessary to dispose the heating apparatus at a location far from the sheet feeding cassette (sheets), and dispose a heater finely and widely so as to be capable of uniformly warming sheets of the largest size, but the adoption of such a construction leads to the bulkiness and high cost of the heating apparatus. Also, the sheets S more readily permit the moisture contained therein to leave off in the portions thereof nearer to the cut end portions thereof and therefore, when the sheets S are simply uniformly heated as described above, there is the undesirable possibility of the moisture remaining more in the central portion of the sheets S.

Also, in a case where the heating apparatus is installed in accordance with the sheets of the largest size, when sheets S of a small size are set, the amount of heat supplied to the sheets S becomes excessively great with a result that not only efficiency becomes worse, but also a temperature rise in an image forming apparatus main body is caused.

In the case of an image forming apparatus for forming a toner image on a photosensitive drum by an electrophotographic process, it is known that the image forming apparatus is liable to be affected by temperature and humidity and particularly, a photosensitive member used as the photosensitive drum has its characteristic affected by temperature and therefore, the evil of an image that the image becomes blurred or stained occurs. Accordingly, when a temperature rise in the image forming apparatus main body is caused as described above and the influence of the temperature rise extends to the photosensitive drum, there is caused the inconvenience that a faulty image also occurs.

SUMMARY OF THE INVENTION

The present invention has been made in view of such circumstances and an object thereof is to provide an image forming apparatus which can appropriately and efficiently effect the removal of moisture in a sheet.

The present invention provides a sheet feeding apparatus provided with sheet stacking means for stacking sheets thereon, sheet feeding means for feeding the sheets stacked on the sheet stacking means, and heating means for heating the sheets stacked on the sheet stacking means, the heating means being designed such that of the heat generating areas of the heating means, the heating value of the area for the central portion of the sheets stacked on the sheet stacking means is greater than the heating value of the other heat generating areas.

Also, in the present invention, the central portion of the heat generating areas of the heating means and the central portion of the sheets stacked on the sheet stacking means coincide with each other.

Also, in the present invention, the heating means generates heat substantially along the diagonals of the sheets stacked on the sheet stacking means.

Also, in the present invention, the heating means is provided substantially in parallelism to the surface of the sheets stacked on the sheet stacking means, the heating means has a wire-shaped heater, and the wire-shaped heater is disposed without intersecting.

Also, in the present invention, design is made such that the heating value of a heat generating area for the central portion of the sheets stacked on the sheet stacking means and at least the leading edge portion of the sheets in the conveying direction thereof is great as compared with the heating value of the other heat generating areas.

Also, in the present invention, the heating means is disposed along the leading edge portion of the sheets stacked on the sheet stacking means in the conveying direction thereof.

Also, in the present invention, the heating means has a wire-shaped heater, and the heating means is designed such that by the wire-shaped heater, the heating value of the heat generating area for the central portion of the sheets stacked on the sheet stacking means is greater than the heating value of the other heat generating areas.

Also, in the present invention, the heating means is constituted by a plurality of wire-shaped heaters.

Also, in the present invention, the image forming apparatus further has control means for controlling the ON/OFF of the plurality of wire-shaped heaters in conformity with the size the sheets stacked on the sheet stacking means.

Also, the present invention provides an image forming apparatus provided with sheet stacking means for stacking sheets thereon, sheet feeding means for feeding the sheets stacked on the sheet stacking means, heating means for heating the sheets stacked on the sheet stacking means, and an image forming portion for forming images on the sheets fed by the sheet feeding means, the heating means being designed such that of the heat generating areas of the heating means, the heating value of the heat generating area for the central portion of the sheets stacked on the sheet stacking means is greater than the heating values of the other heat generating areas.

Also, in the present invention, the heating means is disposed along a recess provided in the frame body of an image forming apparatus main body.

Also, in the present invention, the frame body of the image forming apparatus main body is a bottom plate constituting the bottom of the image forming apparatus main body, and the recess is formed in the bottom plate correspondingly to the diagonals of the sheets stacked on the sheet stacking means.

Also, the present invention provides a heating apparatus having heating means designed such that the heating value in the central portion of the heating area of the heating means is great as compared with the heating value in the other portions.

DETAILED DESCRIPTION OF THE PREFERRED EMBODIMENTS

Some embodiments of the present invention will hereinafter be described in detail with reference to the drawings.

Figure 2:
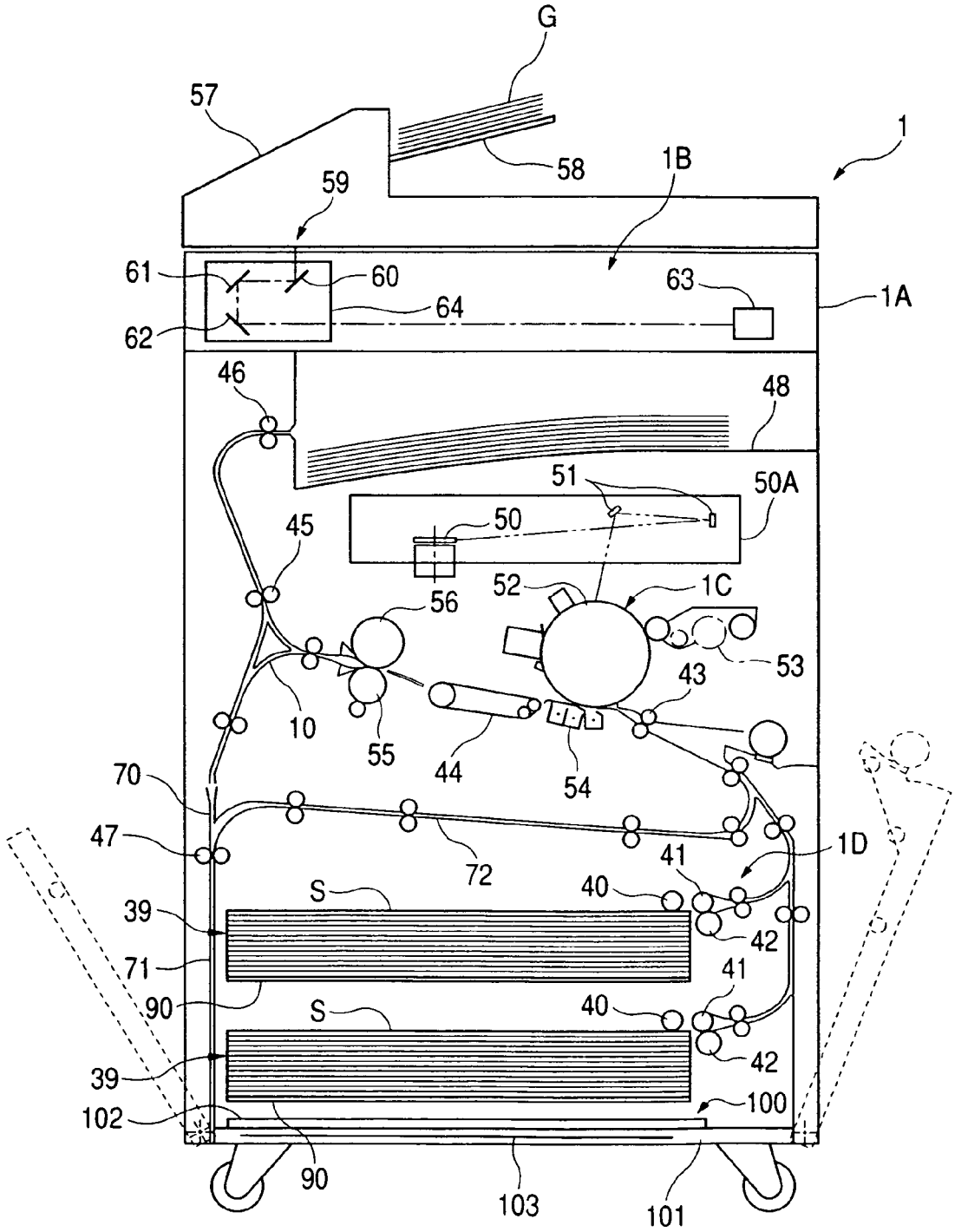
FIG. 2 schematically shows the construction of the image forming apparatus.

FIG. 2 schematically shows the construction of an image forming apparatus according to a first embodiment of the present invention. In FIG. 2, the reference numeral 1 designates the image forming apparatus, and the reference character 1A denotes an image forming apparatus main body (hereinafter referred to as the apparatus main body), and this image forming apparatus 1 is provided with an image reading portion 1B provided in the upper portion of the apparatus main body 1A, an image forming portion 1C disposed below the image reading portion 1B, and a sheet feeding apparatus 1D for feeding sheets S to the image forming portion 1C.

The image reading portion 1B is provided with an automatic original feeding apparatus 57 for conveying originals G set on an original stand 58 one by one in succession to a reading position 59, and an optical system having a light source (not shown) for applying light to the original conveyed to the reading position 59, and an image reading element 63 such as a CCD to which reflected light after reflected from the original G is directed via turn-back mirrors 60, 61 and 62.

Also, the image forming portion 1C is provided with a photosensitive drum 52, a laser scanner 50A for forming an electrostatic latent image on the photosensitive drum, a developing device 53 for developing the electrostatic latent image formed on the photosensitive drum with a toner to thereby form a toner image on the photosensitive drum, and a transferring apparatus 54 for transferring the toner image formed on the photosensitive drum to the sheet S.

In FIG. 2, the reference numeral 100 designates a heating apparatus provided with a radiation plate 102 and a wire-shaped heater 103 which is heating means disposed below the radiation plate 102, and this heating apparatus 100 is adapted to heat the sheets S by heat from the heater 103.

The sheet feeding apparatus 1D has a sheet tray 90 provided as sheet stacking means for stacking the sheets S thereon in a sheet feeding cassette 39, a sheet feeding roller 40 as sheet feeding means for feeding the sheets stacked on the sheet tray 90, a separating portion constituted by a feed roller 41 and a retard roller 42 for separating the sheets fed out by the sheet feeding roller 40 one by one, and the heating apparatus 100. As shown in FIG. 2, heating means 100 is provided substantially in parallelism to the surface of the sheets stacked on the sheet tray 90.

Description will now be made of an image forming operation in the image forming apparatus of such a construction.

When an image is to be formed on the sheet S, an original G is set on the original stand 58 of the automatic original feeding apparatus 57, whereafter a copy button is depressed, whereupon the original G is conveyed to the reading position 59 by the automatic original feeding apparatus 57. Light is applied from the light source (not shown) to the original G, and the reflected light thereof is directed to the image reading element 63 via the turn-back mirrors 60, 61 and 62, whereafter it is converted into an image signal by the image reading element 63, and this image signal is forwarded to the laser scanner 50A of the image forming portion 1C.

This laser scanner 50A is provided with a laser oscillator (not shown) and a polygon mirror 50, and when the image signal from the image reading element 63 is inputted thereto, a laser beam is emitted from the laser oscillator correspondingly to the image signal, and this laser beam is reflected by the polygon mirror 50 being rotated, and is again turned back by a reflecting mirror 51, whereby it is applied onto the photosensitive drum 52.

The photosensitive drum 52 is scanned by the laser beam thus applied from the laser scanner 50A, and an electrostatic latent image is formed on the photosensitive drum 52. Thereafter, this electrostatic latent image is developed and visualized as a toner image by the developing device 53.

Also, in parallel with such a toner image forming operation, the sheet feeding roller 40 is rotated to thereby feed out the sheets S, whereafter the sheets S are separated one by one by the separating portion constituted by the feed roller 41 and the retard roller 42, whereafter registration correction is effected by a pair of registration rollers 43.

Thereafter, the sheet S thus subjected to registration correction by the pair of registration rollers 43 is conveyed to a transferring portion constituted by the photosensitive drum 52 and the transferring apparatus 54, and in this transferring portion, a voltage opposite in polarity to the toner image is applied to the transferring apparatus 54, whereby the toner image is transferred to the sheet S.

Next, the sheet to which the toner image has been transferred is conveyed to a pair of fixing rollers 55 and 56 by a conveying portion 44, and the sheet S is heated and pressurized by the pair of fixing rollers 55 and 56, whereby the toner image is permanently fixed on the sheet. After the toner image has been fixed in this manner, in case of one-side copying in which an image is formed only on a first side, the sheet S is discharged to a sheet discharge tray (not shown) provided outside the apparatus main body.

It is also possible for the sheet S to be discharged not only to the discharge tray, but to an upper sheet discharge portion 48 formed between the image forming portion 1C and the image reading portion 1B, as shown in FIG. 2. In this case, the sheet S discharged from the pair of fixing rollers 55 and 56 is thereafter discharged to and stacked on the upper sheet discharge portion 48 via a changeover flapper 10 and via a pair of reversing rollers 45 and a pair of sheet discharge rollers 46.

When the sheets S are to be discharged to the upper sheet discharge portion 48, unlike a case where the sheets are discharged onto the discharge tray, the sheets S are successively outputted and stacked with their image surfaces facing down and thus, they are stacked in the order of output at a point of time whereat the outputting has been terminated. Therefore, as an outputting method from a computer or the like, this is a more popular discharging method.

On the other hand, in the case of two-side copying in which an image is also formed on a second side, the sheet S onto one side of which an image has been transferred is passed between the pair of fixing rollers 55 and 56, and thereafter is corned toward a reverse path 71 by the reversal of a pair of reverse rollers 45 and the changeover of the changeover flapper 10.

Next, when the trailing edge of the sheet S thus conveyed toward the reverse path 71 passes an elastic sheet 70 for reversal changeover provided on the reverse path 71, a reverse roller 47 is reversely rotated, whereby the sheet S comes into a two-side path 72 by the action of the elastic sheet 70. After the sheet S has thus come into the two-side path 72, the sheet S is again conveyed to the transferring portion, where an image is transferred thereto, whereafter the sheet S passes between the pair of fixing rollers 55 and 56, whereby an image for the second side is formed on the sheet.

Now, the sheet S more readily permits moisture contained therein to leave off (dry) in the portions thereof nearer to the out end portions thereof and thus, when the sheet S is simply uniformly heated, much moisture remains in the central portion of the sheet S.

When much moisture remains in the central portion as described above, there is caused the phenomenon that in that portion a transferring current flows through the sheet S, and this causes a difficulty in an image and therefore, it is necessary to increase the drying efficiency of the central portion of the sheet as much as possible.

Also, in the phenomenon that in case of heating during fixing, the sheet S twines around the pair of fixing rollers 55 and 56 due to the curl of the sheet caused by the moisture contained in the sheet S evaporating, the curl of the leading edge portion of the sheet S in the conveying direction thereof is the direct factor of occurrence. Therefore, it is also necessary to preponderantly dry the leading edge portion of the sheet so as to decrease the amount of moisture to the utmost. Further, supposing a case where an image is also formed on the back of the sheet, it is desirable to increase the drying efficiency of the trailing edge portion of the sheet S as well.

Figure 1:
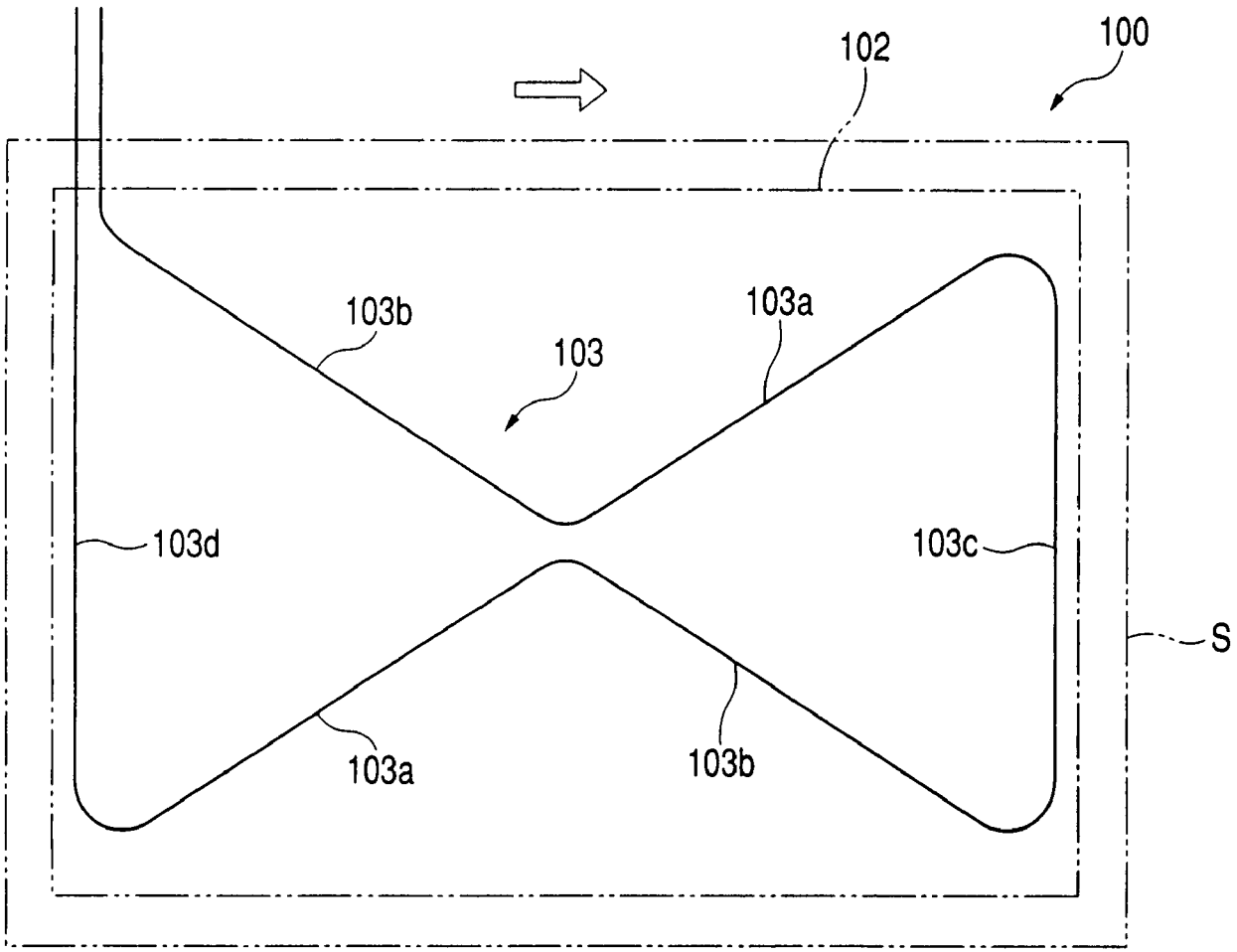
FIG. 1 is a plan view showing the construction of a heating apparatus provided in an image forming apparatus according to a first embodiment of the present invention.

So, in the present embodiment, the heater 103, as shown in FIG. 1, is provided with heat generating portions 103*a* and 103*b* disposed along the diagonal directions of the sheet S and without intersecting with each other, and heat generating portions 103*c* and 103*d* disposed along the leading edge and trailing edge of the sheet S which are the opposite ends orthogonal to a sheet conveying direction indicated by arrow. That is, the wire-shaped heater 103 is disposed substantially in the shape of 8 (the figure of eight). Accordingly, the heater 103 is designed such that the amount of generated heat in the central portion of the heat generating area of the heater 103 in which the heat generating portions 103*a* and 103*b* concentrate is greater than in the other portions.

Figure 3:
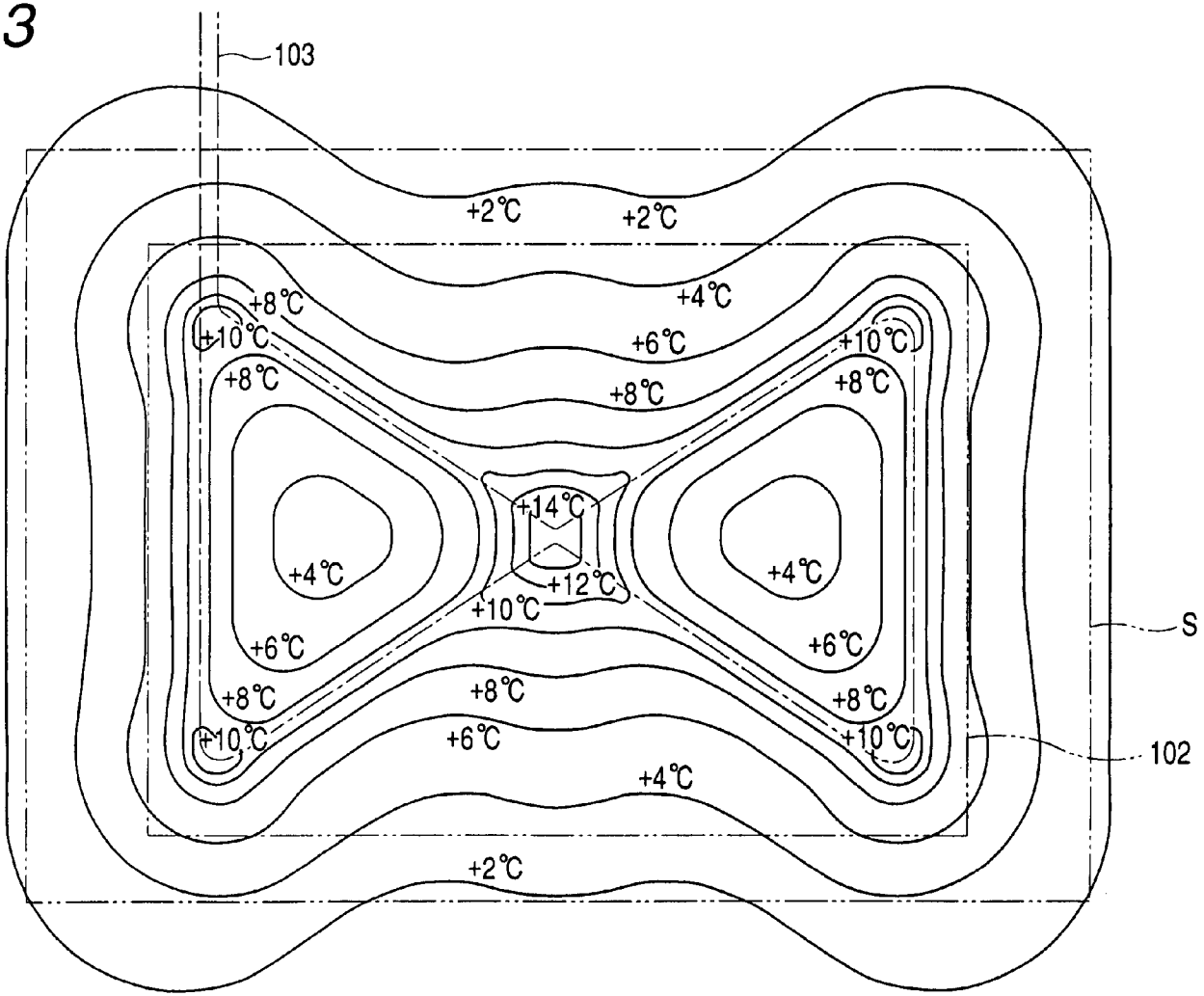
FIG. 3 shows the temperature distribution of the heating apparatus.

The heater 103 is disposed so that the central portion of the heat generating area of the heater 103 may coincide with the central portion of the sheet S. Consequently, the heater 103 is designed such that of the heat generating areas of the heater 103, the heating value in a heat generating area for the central portion of the sheet S is greater than the heating value in the other heat generating areas than the heat generating area for the central portion of the sheet. Also, the heat generating portions 103*c* and 103*d* are disposed at locations corresponding to the leading edge and trailing edge of the sheet S so that the heater 103 may generate heat along the leading edge and trailing edge of the sheet S in the sheet conveying direction. The heat distribution of the sheet S by the heater 103 as described above is such a distribution as shown in FIG. 3. That is, the heat distribution of the heater

103 is high in the central portion and the leading edge portion and trailing edge portion of the sheet S.

Thus, when the sheet S is dried by the heater 103 having such a temperature distribution, the central portion in which the greatest amount of moisture is liable to remain is heated more than the other portions and likewise, the leading edge portion and trailing edge portion of the sheet in which it is desired to make the amount of contained moisture small are also heated more. As a result, the amounts of moisture in the central portion and the leading edge portion and trailing edge portion of the sheet S can be reliably suppressed and moreover, it is possible to generally bring the sheet S into a substantially uniformly dried state.

By bringing the sheet S into such a state, the problem of short-circuiting during transfer which affects an image as already described does not arise, and it becomes possible to suppress such an evil in conveyance as the twining of the sheet S around the photosensitive drum 52 and the pair of fixing rollers 55 and 56 caused by the curl of the end portions of the sheet.

By the heat generating portions 103*a* and 103*b* of the heater 103 being disposed substantially along the diagonals of the sheet S as described above, the heating value for the central portion of the sheet S can be made great as compared with that for the other portions. Also, by the heat generating portions 103*c* and 103*d* of the heater 103 being disposed at locations corresponding to at least the end portions of the sheet S, in the present embodiment, the leading edge portion and trailing edge portion of the sheet S, the heating value in the heat generating areas for the leading edge portion and trailing edge portion of the sheet can be made great as compared with the heating value in the other heat generating areas. Thereby, the sheet S can be dried more uniformly, and it becomes possible prevent various problems in an image caused by the non-uniformity of the dried state of the sheet S.

Now, in the present embodiment, the radiation plate 102 is mounted on the upper surface of a bottom plate 101 which is a portion of the frame body of the apparatus main body 1A.

All parts of the apparatus main body 1A are assembled on this bottom plate 101 and therefore, it is desirable that the strength of the bottom plate be great to the utmost and thus, for such reasons as the ease of machining and a low cost, as the bottom plate 101, use is made of not one constructed simply by bending a metal plate, but one subjected to drawing.

Figure 4:
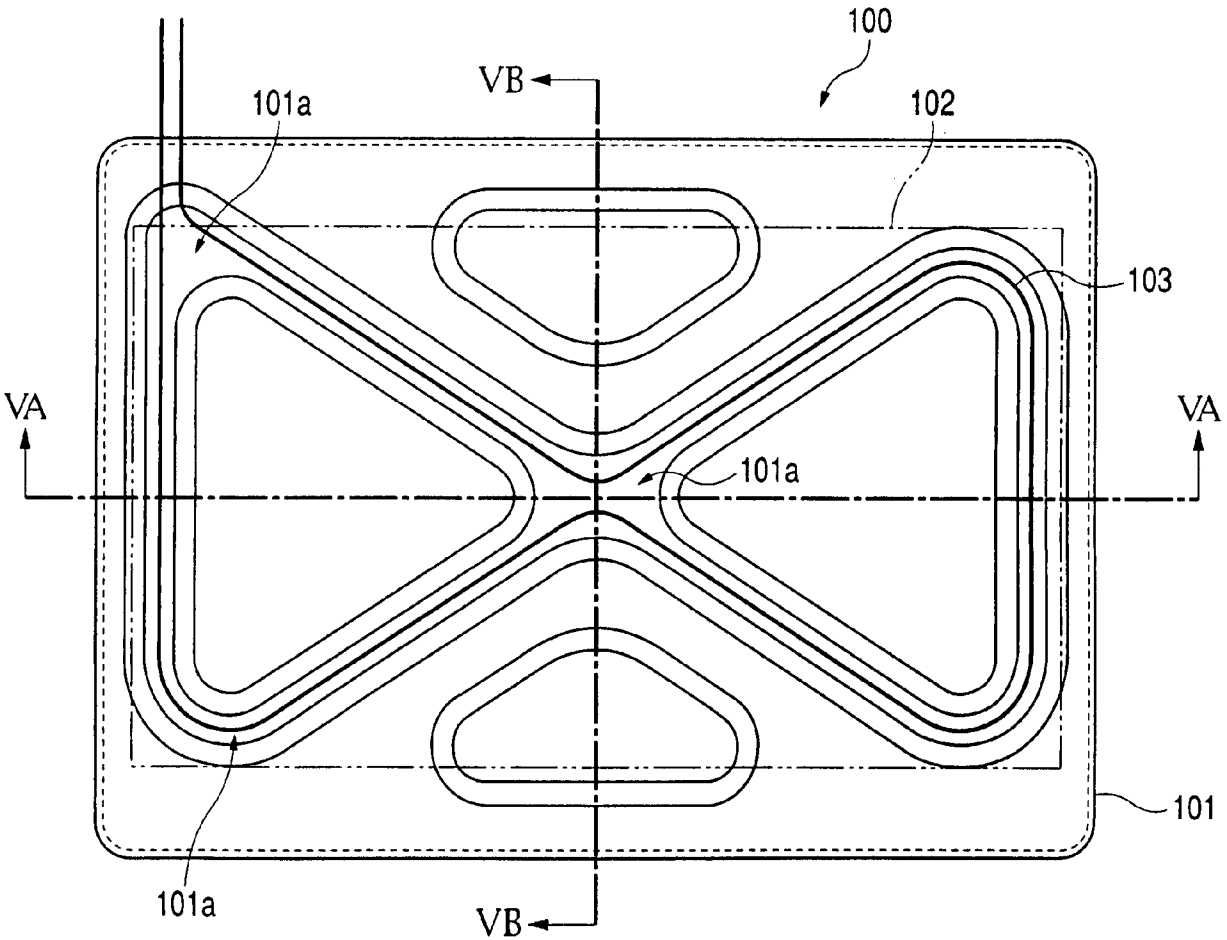
FIG. 4 shows the disposition of a heater provided in the heating apparatus.

Also, generally it is known that a drawn shape comprising such X-shaped unevenness as shown in FIG. 4 is more effective in strength than forming the bottom plate 101 in a shape having its four side simply bent. This is because by obliquely adding drawing to the construction of a flat plate, there is obtained an effect similar to that of obliquely laying a beam, and thereby strength can be secured against deformation in X-direction and Y-direction applied to the bottom plate.

Figure 5A:
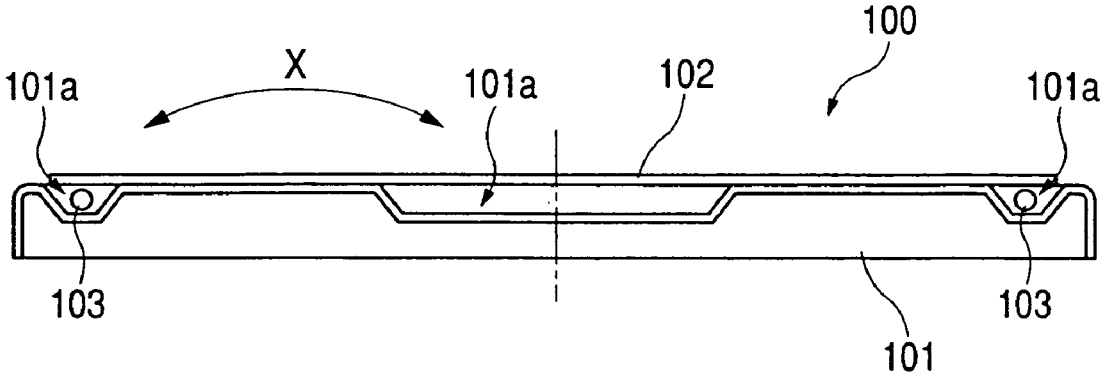
FIG. 5A is a cross-sectional view taken along the line VA—VA of FIG. 4.
Figure 5B:
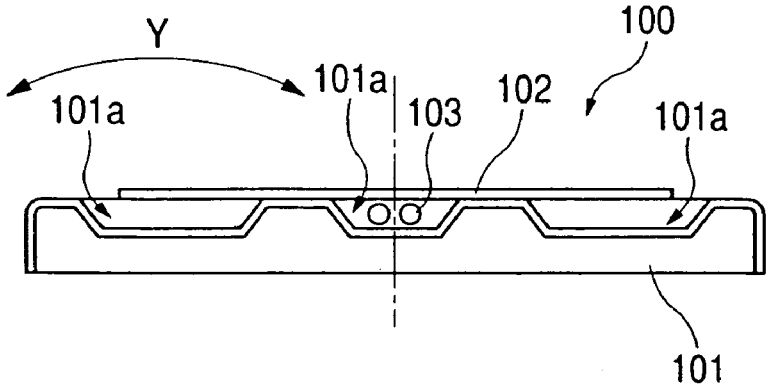
FIG. 5B is a cross-sectional view taken along the line VB—VB of FIG. 4.

So, in the present embodiment, as shown in FIGS. 5A and 5B, a recess 101*a* of a drawn shape is formed in the bottom plate 10 to thereby secure strength. Further, this recess 101*a* is formed correspondingly to the diagonals of the sheet S and the heater 103 is disposed along this recess 101*a* of the bottom plate 101. FIG. 5A shows a cross section VA—VA in FIG. 4, and FIG. 5B shows a cross section VB—VB in FIG. 4.

By the heater 103 being thus disposed along the recess 101*a* of the bottom plate 101, i.e., in the recess, it becomes possible to dispose the heater 103 without taking the height of the portion of the heater 103 into consideration. As a result, the space saving of the entire heating apparatus can be achieved and it becomes possible to make the distance between the sheet S and the heater 103 greater. It is effective in avoiding the localized heating by the heater 103 to make the distance from the heater 103 to the sheet S greater as described above, and by adopting such a construction, more uniform drying of the sheet becomes possible.

By disposing the heater 103 along the recess 101*a* provided in the bottom plate 101, as described above, it becomes possible to secure the distance of the heater 103 to the sheet S without increasing the size of the heating apparatus 100 and without spoiling the strength of the frame body of the apparatus main body 1A. Thereby, the localized overheating by the heater 103 can be avoided and more uniform heating and humidity removal of the sheet become possible.

Now, while in the description hitherto made, a case where the wire-shaped single heater 103 is disposed at the location as shown in FIG. 1 has been described, the present invention is not restricted thereto, but the heater may be divided into a plurality for use.

Figure 6:
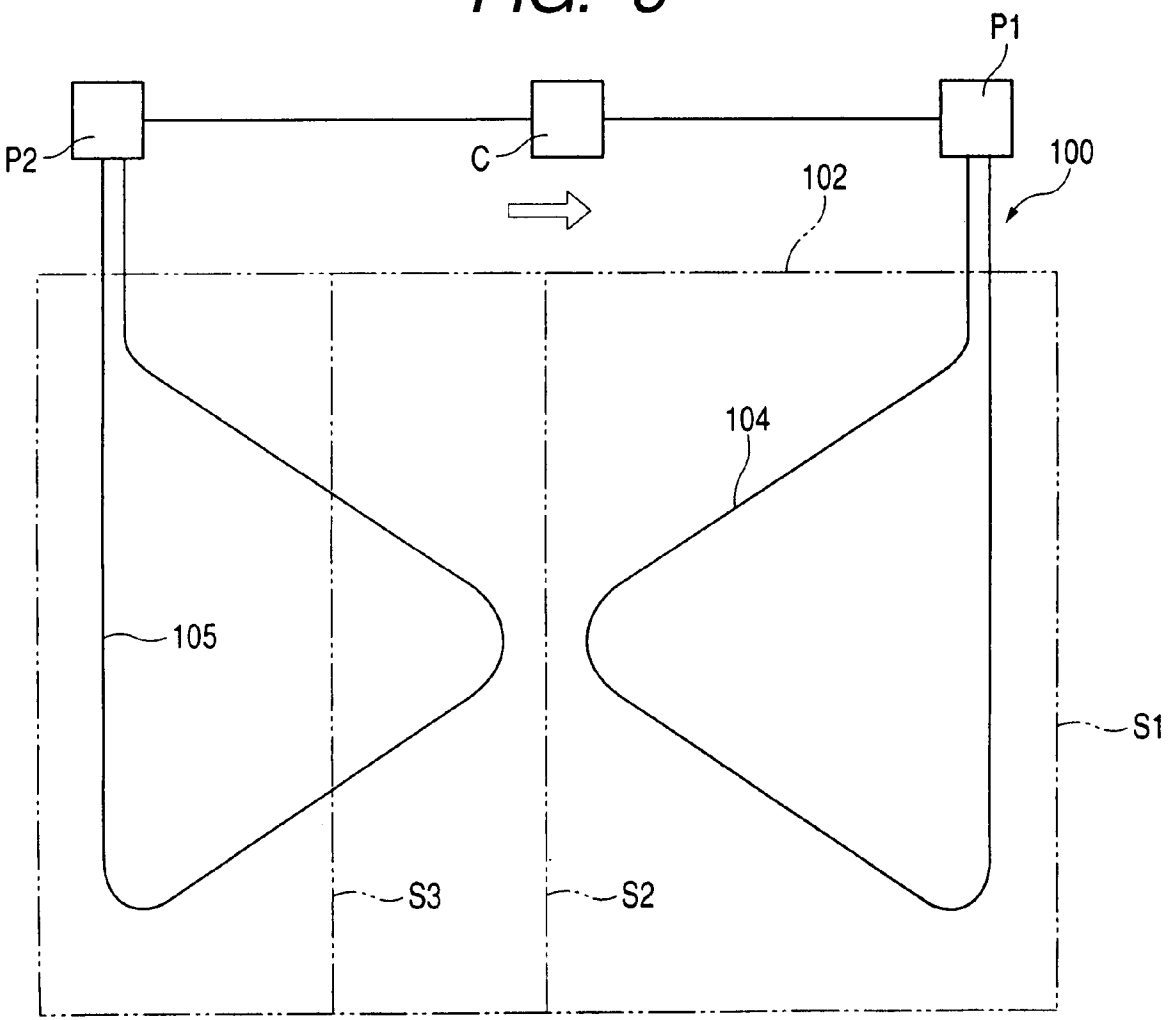
FIG. 6 is a plan view showing a modification of the heating apparatus of the present invention.

FIG. 6 shows a heating apparatus designed to heat the sheet by such a plurality of heaters.

FIG. 6 is a plan view showing the construction of the heating apparatus designed to heat the sheet by a plurality of heaters. The heater is divided into two, and these two divided heaters 104 and 105 are disposed on the bottom plate 101 so as to assume a substantially triangular shape and symmetrically with the center of the bottom plate 101 as the boundary. That is, the two wire-shaped heaters 104 and 105 are disposed substantially in the shape of 8 (the figure of eight). Consequently, the heat distribution by the heaters 104 and 105 is a heat distribution similar to that in the above-described case where heat is generated by a heater, and the heating value in the central portions of the heat generating areas of the two heaters 104 and 105 which are heating means are greater than in the other portions.

These two heaters 104 and 105 are of a construction in which they are supplied with electric power from power source units P1 and P2, respectively, and can be singly ON-OFF-controlled by a controller C which is control means.

When the sheet S is a sheet S1 of as large a size as covers the both heaters 104 and 105, the controller C is adapted to bring both of the heaters into an ON state. Thereby, as in the already described first embodiment, the central portion of the sheet S1 is more heated and the leading edge portion and trailing edge portion of the sheet can also be more heated, and the sheet S1 can be dried more uniformly.

Also, when the sheet S is a sheet S2 of a size which is a half of the large-sized sheet S1 and covers only one heater 104, design is made such that the other heater 105 is switched off and the sheet S2 is heated by one heater 104 alone. Even if design is made such that as described above, one heater 104 alone is heated, this heater 104 is disposed in a direction generally along the diagonals relative to the sheet S2 as shown in FIG. 6, whereby drying progresses in the entire sheet S2.

Also, this heater 104 preponderantly dries the leading edge portion of the sheet S in the sheet conveying direction, whereby as in the already described first embodiment, it becomes possible to prevent the occurrence of the curl of the leading edge which would otherwise cause the twining or the like of the sheet S2 around the pair of fixing rollers 55 and 56.

Further, when the sheet S2 of such a small size is used, the other heater 105 which is then not necessary is switched off, whereby the temperature rise of the apparatus main body 1A is suppressed, whereby it becomes possible to prevent the evil of an image which would otherwise caused particularly when the temperature rise in the apparatus main body has extended to around the photosensitive drum. Also, heating as required can be done, and this is also effective for the energy saving of the heating apparatus 100.

Also, when the sheet S is a sheet S3 of a size which covers the whole of one heater 104 and a part of the other heater 105, the controller C controls the ON time of the two heaters 104 and 105 in conformity with the size so as to increase the heating density of one heater 104.

For example, one heater 104 is always switched on and the other heater 105 is intermittently switched on, or one heater 104 is intermittently switched on and the other heater 105 is intermittently switched on at longer intervals, whereby the heating density of one heater 104 is increased. By the heating density of one heater 104 being thus increased, the heated state of the sheet S can be made more uniform and more proper.

By dividing the heater into two (a plurality) and controlling the ON and OFF of these divided heaters 104 and 105, as described above, the heating of the sheet S conforming to the size of the sheet becomes possible, and even when the sheet S of a small size is to be heated, it will never happen that even a portion in which the sheet S is absent is excessively heated. Thereby, the temperature rise in the apparatus main body by the heaters 104 and 105 can be suppressed and as a result, it becomes possible to suppress any evil to an image resulting from the temperature rise, and the energy saving of the heating apparatus 100 also becomes possible.

Figure 7:
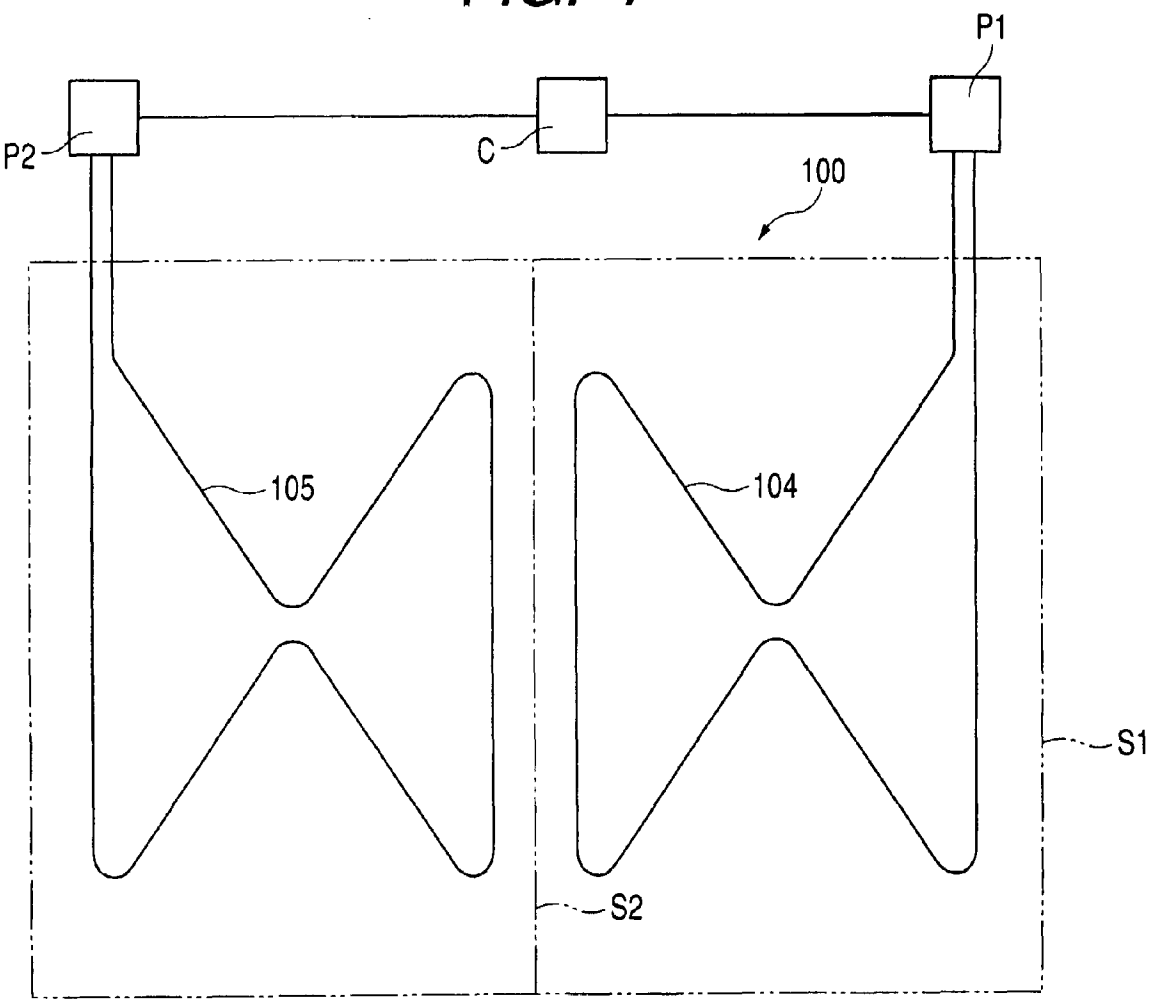
FIG. 7 is a plan view showing another example of a heater in the modification of the heating apparatus.
Figure 8:
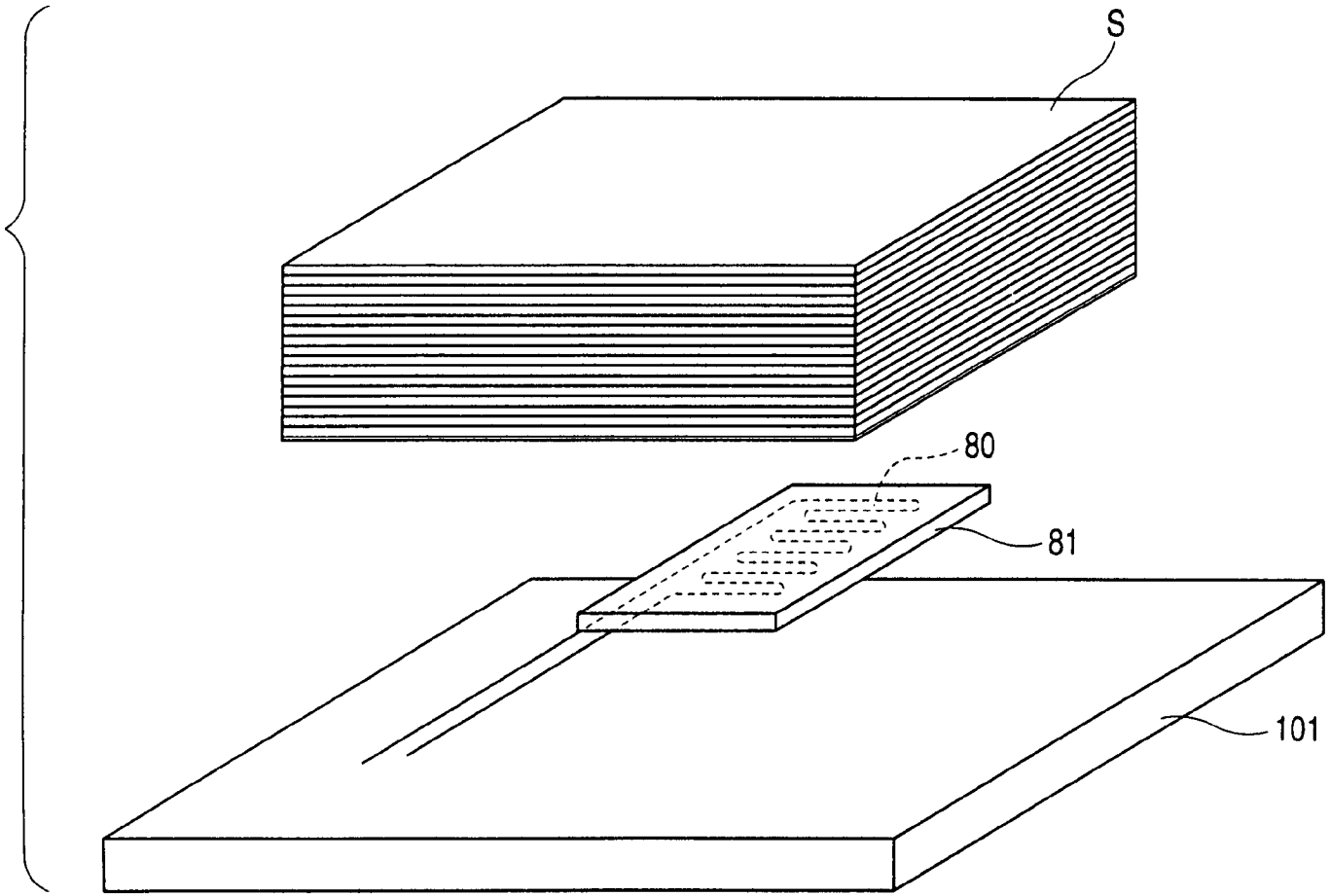
FIG. 8 shows the construction of a conventional heating apparatus.
Figure 9:
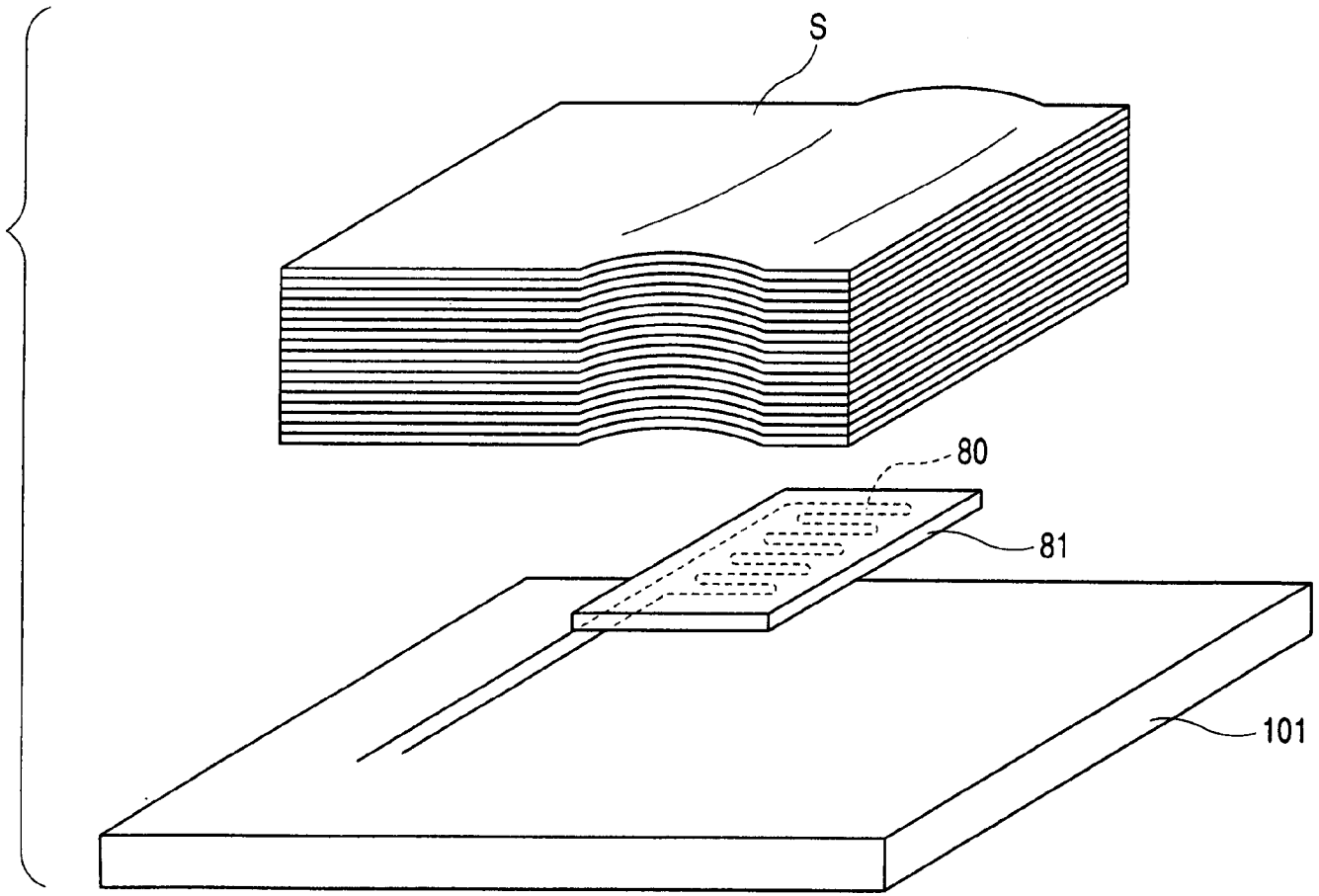
FIG. 9 shows the wavy deformation of sheets when a humidity distribution and a temperature distribution are remarkably partial.

While in the description hitherto made, a case where the divided heaters 104 and 105 are disposed line-symmetrically on the bottom plate 101 along the diagonals of the sheet S and so as not to intersect with each other has been described, the shape of the heaters 104 and 105 is not limited to such a shape, but when for example, sheets S2 of a small size are used in a great deal, the shape of the two heaters 104 and 105 may be such a shape as shown in FIG. 7 so that the central portion and the leading edge portion and trailing edge portion of the sheets S2 of the small size can be more heated. Again in the case of the heating apparatus shown in FIG. 7 of the heat generating areas of the heater 105, the heating value in a heat generating area for the central portion of the sheets S2 of the small size becomes greater than the heating value in the other heat generating portions.

Now, while in the description hitherto made, a case where the heating apparatus 100 is disposed on the bottom plate 101 has been described, the present invention is not restricted thereto, but in a case where as shown, for example, in FIG. 2, a plurality of sheet feeding cassettes 39 are disposed in a vertical direction, a frame body similar in construction to the bottom plate 101 may be provided below each of the sheet feeding cassettes 39, and the heating apparatus 100 may be disposed in this frame body.

Also, while in the description hitherto made, the shape of the heater or heaters has been described as being wire-shaped, the present invention is not restricted thereto, but if the heater can be disposed in the recess provided in the bottom plate 101, a heater of other shape, e.g. a plate shape, may be used.

The invention claimed is:

1. A sheet feeding apparatus comprising:
a sheet tray on which sheets are stacked;
a sheet feeding member which feeds the sheets stacked on said sheet tray; and
a heater, which heats the sheets stacked on said sheet tray,
wherein said heater generates heat along diagonals of the sheets stacked on said sheet tray.

2. A sheet feeding apparatus according to claim 1, wherein said heater has a wire-shaped heater disposed along diagonals of the sheets stacked on said sheet tray.

3. A sheet feeding apparatus according to claim 1, wherein said heater further generates heat along a leading edge portion of the sheets on said sheet tray in a sheet feeding direction of the sheets.

4. A sheet feeding apparatus according to claim 1, further comprising a plate-like frame of an apparatus main body
wherein said plate-like frame has a recess along diagonals of the sheets stacked on said sheet tray, and said heater is disposed in said recess.

5. A sheet feeding apparatus according to claim 1, wherein the heat distribution of said heater is designed such that the temperature of an area of said heater facing a central portion of the sheets stacked on said sheet tray is higher than the temperature of the another area of said heater facing another portion of the sheets.

6. A sheet feeding apparatus according to claim 1, wherein said heater has a wire-shaped heater, and at least a part of said wire-shaped heater is disposed along diagonals of the sheets stacked on said sheet tray.

7. An image forming apparatus comprising:
a sheet tray on which sheets are stacked;
a sheet feeding member which feeds the sheet stacked on said sheet tray;
a heater which heats the sheets stacked on said sheet tray; and
an image forming portion which forms images on the sheets fed by said sheet feeding member,
wherein said heater generates heat along diagonals of the sheets stacked on said sheet tray.

8. An image forming apparatus according to claim 7, wherein said heater has a wire-shaped heater disposed along diagonals of the sheets stacked on said sheet tray.

9. An image forming apparatus according to claim 7, further comprising a plate-like frame of an apparatus main body, wherein said plate-like frame has a recess along diagonals of the sheets stacked on said sheet tray, and said heater is disposed in said recess.

10. An image forming apparatus according to claim 7, wherein a heat distribution of said heater is designed such that the temperature of an area of said heater facing a central portion of the sheets stacked on said sheet tray is higher than the temperature of another area of said heater facing another portion of the sheets.

* * * * *

UNITED STATES PATENT AND TRADEMARK OFFICE

CERTIFICATE OF CORRECTION

PATENT NO. : 7,233,767 B2
APPLICATION NO. : 11/121138
DATED : June 19, 2007
INVENTOR(S) : Saijiro Endo et al.

It is certified that error appears in the above-identified patent and that said Letters Patent is hereby corrected as shown below:

COLUMN 1
Line 37, “mush” should read --much--.

COLUMN 2
Line 12, “warily deformed” should read --wavily deformed--.

COLUMN 3
Line 30, “size the sheets” should read --size of the sheets--.

COLUMN 4
Line 40, “reflected” should read --being reflected--.

COLUMN 5
Line 43, “in case of” should read --in the case of--.

COLUMN 6
Line 1, “corned” should read --conveyed--.
Line 26, “that in case of” should read --in the case of--.

COLUMN 7
Line 34, “possible prevent” should read --possible to prevent--.
Line 51, “four side” should read --four sides--.

COLUMN 9
Line 5, “caused” should read --be caused,--.
Line 41, “used in a great deal,” should read --used a great deal--.

UNITED STATES PATENT AND TRADEMARK OFFICE

CERTIFICATE OF CORRECTION

PATENT NO. : 7,233,767 B2
APPLICATION NO. : 11/121138
DATED : June 19, 2007
INVENTOR(S) : Saijiro Endo et al.

It is certified that error appears in the above-identified patent and that said Letters Patent is hereby corrected as shown below:

COLUMN 10
Line 21, "main body" should read --main body,--.

Signed and Sealed this

Twenty-fifth Day of March, 2008

JON W. DUDAS
*Director of the United States Patent and Trademark Office*